US005137056A

United States Patent [19]

Christopher et al.

[11] Patent Number: 5,137,056

[45] Date of Patent: Aug. 11, 1992

[54] AIR FLAPPER VALVE ASSEMBLY

[75] Inventors: Delbert S. Christopher; Lance J. Evens, both of Carrollton, Tex.

[73] Assignee: Lennox Industries Inc., Dallas, Tex.

[21] Appl. No.: 736,483

[22] Filed: Jul. 26, 1991

[51] Int. Cl.[5] ..... F16K 15/14; F23C 11/04

[52] U.S. Cl. ..... 137/854; 251/368; 431/1; 431/20

[58] Field of Search ..... 137/854; 431/1, 20; 251/368

[56] References Cited

U.S. PATENT DOCUMENTS 4,253,641 3/1981 Van Ryck ..... 251/368
4,475,621 10/1984 Cherington et al. ..... 431/1
4,655,247 4/1987 Westra et al. ..... 251/368
4,672,919 6/1987 Staats ..... 431/20
4,697,358 10/1987 Kitchen ..... 431/1
4,715,807 12/1987 Yokoyama et al. ..... 431/1
4,815,704 3/1989 Berchem ..... 251/315
4,881,373 11/1989 Yamaguchi et al. ..... 431/1
4,955,805 9/1990 Ishiguro et al. ..... 431/1

*Primary Examiner*—A. Michael Chambers
*Attorney, Agent, or Firm*—Allegretti & Witcoff, Ltd.

[57] ABSTRACT

The present invention relates generally to pulse combustion furnaces, and more particularly to an improved air flapper valve assembly for use in association therewith, such improved air flapper valve assembly having a valve body formed from an elastomeric material which results in significant reduction in air valve sound and vibration.

6 Claims, 1 Drawing Sheet

AIR FLAPPER VALVE ASSEMBLY

BACKGROUND OF THE INVENTION

The present invention relates generally to pulse combustion furnaces, and more particularly to an improved air flapper valve assembly for use in association therewith, such improved air flapper valve assembly having a valve body formed from an elastomeric material which results in significant reduction in audible sound and vibration.

Problems associated with less efficient prior art furnaces have been substantially ameliorated with the development of the pulse combustion furnace, wherein the fuel is burned in separate distinct "pulses", rather than in a continuously burning flame. In the pulse combustion furnace, the combustion air is drawn in from outside, and the combustion products are vented to the outside, both of which are entirely independent of and thus have no opportunity to enter the conditioned space. In addition, the pulse combustion process has the benefit of utilizing a minimum amount of heat exchanger material in order to transfer the heat released during the combustion process, due to the inherent nature of the pulsating flow as being turbulent, which accordingly enhances the heat transfer characteristics inherent in the pulse combustion process. In addition, the pulse combustion process permits the flexibility of firing at various input rates, and also produces reduced amounts of nitrous oxide emissions, as compared with prior art systems.

However, certain difficulties or deficiencies have been noted in the otherwise greatly beneficial pulse combustion process. Most notably, noise associated with the pulse combustion process has proved to be a difficult and continuing challenge. In particular, a bare pulse combustion burner with no sound attenuation apparatus can emit a sound level of 90 to 100 dbA in the vicinity of the device. As the acceptable indoor sound level is only 65 dbA, attenuation of the emitted sound to about 1% of the bare burner level sound has been necessitated. Moreover, low frequency sounds associated with various vibrations with regard to the pulse burner have likewise proved to be difficult of reduction, and have in the past only been attenuated effectively by the use of considerable mass in the sound absorbance shielding apparatus. A secondary problem has been the generation of harmonic frequencies caused by the 60 Hz fire rate. One contributor to the substantial level of sound associated with pulse combustion furnaces has been the air flapper valves used in connection therewith. For example, a substantial level of sound generation has been associated with the opening and closing of these prior art air flapper valves with each pulse.

Lennox Industries Inc., the assignee hereof, has been an industry-wide leader in pulse combustion furnace technology and in associated sound attenuation equipment. Notwithstanding the previous improvements in sound reduction accomplished with regard to advanced pulse combustion furnace design, further reduction in sound has been desirable in the art. Thus, in view of the prior art problems associated especially with sound reduction in regard to pulse combustion furnaces, it is a material object of the present invention to provide an improved air flapper valve assembly for use in association with a pulse combustion furnace which will substantially reduce the sound and vibration emanating from pulse combustion furnaces.

It is a further object of the improved air flapper valve assembly of the present invention to provide an air flapper valve assembly having a valve body formed from an elastomeric material which has a defined hardness and a defined thermal resistance thereby to give rise to the desired characteristics.

SUMMARY OF THE INVENTION

The improved air flapper valve assembly of the present invention is utilized in association with a pulse combustion furnace. The air flapper valve assembly is connected to the air intake of the pulse combustion furnace and has a valve body supporting a flapper valve disposed thereon. The present inventive improvement in air flapper valve assemblies comprises a valve body formed from an elastomeric material which has a hardness in the range of 35 to 52 Shore D. Suitable elastomeric materials for forming the improved valve body component hereof maybe selected from the group consisting of a heat stabilized copolyester EPDM, a copolyester EPDM, and copolypropylene EPDM.

The air flapper valve assembly of the present invention will be better understood by those skilled in the art with reference to the following brief description of the drawing, detailed description of preferred embodiments, accompanying drawing and appended claims.

BRIEF DESCRIPTION OF THE DRAWING

In the accompanying drawing, wherein common numerals are utilized for common elements, the air flapper valve assembly of the present invention is depicted, and in which.

DETAILED DESCRIPTION OF PREFERRED EMBODIMENTS

The improved air flapper valve assembly of the present invention is utilized in association with a pulse combustion furnace. The improved air flapper valve assembly of the present invention functions to isolate the impact of the air valve from the heat exchanger structure, which assists in preventing transmission of noise/vibration/clatter to the conditioned space. The air flapper valve assembly is connected to the air intake conduit of the pulse combustion furnace and has a valve body supporting a flapper valve disposed thereon. The present inventive improvement in air flapper valve assemblies comprises a valve body formed from an elastomeric material which has a hardness in the range of 35 to 52 Shore D. Suitable elastomeric materials for forming the improved valve body component hereof may be selected from the group consisting of a heat stabilized copolyester EPDM, a copolyester EPDM, and copolypropylene EPDM.

One especially functional copolyester EPDM is LOMOD XB0225; the copolyester EPDM may preferably be LOMOD B0220; and the copolypropylene EPDM is preferably Santoprene 103-40. "SANTOPRENE" is a Registered Trademark of Monsanto Corporation. "LOMOD" is a Registered Trademark of the General Electric Corporation. "EPDM" is a term known to those skilled in the art as referring to a terpolymer elastomer made from ethylenepropylene-diene monomer.

The particular durometer range of hardness for the elastomeric material(s) which is beneficially utilizable in association with the valve body hereof is in the range of 35 to 52 Shore D. Such elastomeric material cannot be too hard, otherwise it will transmit sound and/or vibration, similar to a metallic substance. Likewise, the elastomeric material for forming the valve body hereof cannot be too soft, as it would not permit adequate machining, would not hold screws well, and would not withstand the temperature range which it would face in the high temperature environment of a valve body for an air flapper valve assembly. Accordingly, the elastomeric material for forming such valve body must be able to withstand a temperature environment of at least approximately 350° F. without significant thermal degradation.

Figure 1:
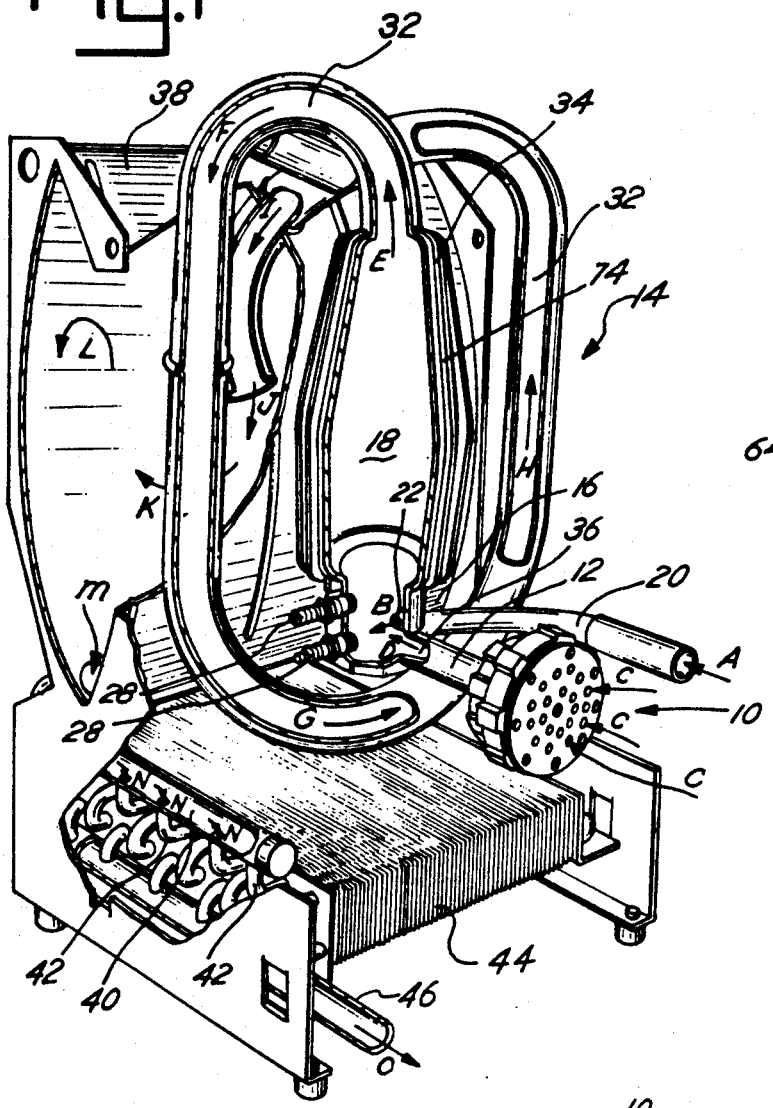
FIG. 1 is a partially cut away perspective view of the interior components of a pulse combustion furnace showing the air flapper valve assembly connected to the combustion chamber by means of an air input conduit disposed at approximately 90° to and closely adjacent to gas input orifice, which is disposed oppositely of spark plugs within the combustion chamber for causing combustion of the gas and air mixture, the heated combustion products of which are vented to an accompanying heat exchanger apparatus.

Referring now to the drawing, and to FIG. 1 in particular, the air flapper valve assembly of the present invention generally 10 is connected to the air intake conduit 12 of a pulse combustion furnace generally 14. Air intake conduit 12 is attached at lower portion 16 of combustion chamber 18 and adjacent the closely disposed gas input conduit 20 for the entry of gaseous fuel thereinto (See Arrow A), which gas enters lower portion 16 of combustion chamber 18 at gas input orifice 22 thereof (See Arrow B). Likewise, a stream of air enters air flapper valve assembly 10 through holes 24 in cover plate 26 thereof (See Arrows C), and enters lower portion 16 of combustion chamber 18 at Arrow D.

After the entry of the air and gas mixture into lower portion 16 of combustion chamber 18, the pulse cycle is initiated by a spark emanating from the spark plug 28, which ignites the gas and air mixture. Such ignition of the gas and air mixture therepresent constitutes one pulse. Whereupon, the positive pressure from the combustion of the gas and air mixture closes flapper valve 30 (as described in more detail hereinbelow) and forces the exhaust gases down tail pipe 32 (See Arrow E). Although tail pipe 32 may be of various dispositions and forms, one preferred form of tail pipe 32 is attached at top portion 34 of combustion chamber 18, and has a diameter comparable to, but preferably slightly smaller than lower portion 16 of combustion chamber 18. As shown in FIG. 1, lower portion 16 of combustion chamber 18 contains gas input orifice 22, air input orifice 36, spark plug 28, and sensor **28*b*. Also as depicted in FIG. 1 hereof, combustion chamber 18 may comprise a generally barrel-shaped centrally disposed expansion portion 18 disposed atop the generally cylindrical-shaped lower portion 16** which functions as an ignition chamber, and which has a somewhat smaller diameter.

Tail pipe 32 may be disposed in a generally U-shaped configuration and may preferably be formed of walls having a substantial wall thickness in order to serve to diminish some of the sound caused by the explosive "pulse" occurring within combustion chamber 18. As shown in FIG. 1, tail pipe 32 is attached to upper portion 34 of the combustion chamber 18 and the exhaust contained therein is directed to curve downwardly (See Arrow F), and under air input conduit 12 (See Arrow G). Tail pipe 32 thereafter curves upwardly again (See Arrow H), and around and back of the top loop of tail pipe 32 (See Arrow I) and into exhaust decoupler 38 (See Arrow J). Exhaust decoupler 38 is relatively large in size and should be formed of walls of a sufficient thickness to provide a sound deadening mass, again to serve to diminish the sounds generated by the explosive "pulse" emanating from the combustion chamber.

After distribution and circulation within exhaust decoupler 38 (See Arrows K, L), the heated combustion products enter tubular shaped manifold 40 of much smaller diameter (See Arrow M) for entry into heat exchanger tubes 42 (See Arrow N), which are equipped with a plurality of heat radiation fins 44 for transfer of heat therefrom. Thereafter, the exhausted heat combustion stream is vented through manifold exhaust pipe 46 (See Arrow O) for exhaust to the exterior.

With regard to the pulse cycle, and after the first cycle has forced exhaust gases into tail pipe 32 in the above described route, exhaust gases leaving combustion chamber 18 create negative pressure therein, which opens flapper valve 30, thereby drawing in an additional portion of gas and air for the next combustion pulse. Simultaneously therewith, a part of the prior pulse adjacent top portion 34 of combustion chamber 18 is reflected back into combustion chamber 18 from tail pipe 32 causing the new gas and air mixture to ignite. No spark from spark plug 28 is required. This is the second pulse. The above steps of creation of a negative pressure for drawing in gas and air, and reflecting back from the prior pulse of sufficient thermal energy to ignite the next alloquet of gas, and air are repeated 50 to 65 times per second, forming consecutive pulses of approximately ¼ to ½ Btu each. As described above, latent heat is removed from the combustion products and condensate (water) is formed in the condenser coil also for venting.

As shown in the pulse combustion furnace 14 of FIG. 1, various of the components including combustion chamber 18, tail pipe 32, and exhaust decoupler 38, are formed of material having a mass sufficient to diminish substantially the amount of sound energy emanating therefrom. However, even these improvements in sound reduction have been less than optimal, and additional improvement has been indicated.

Figure 2:
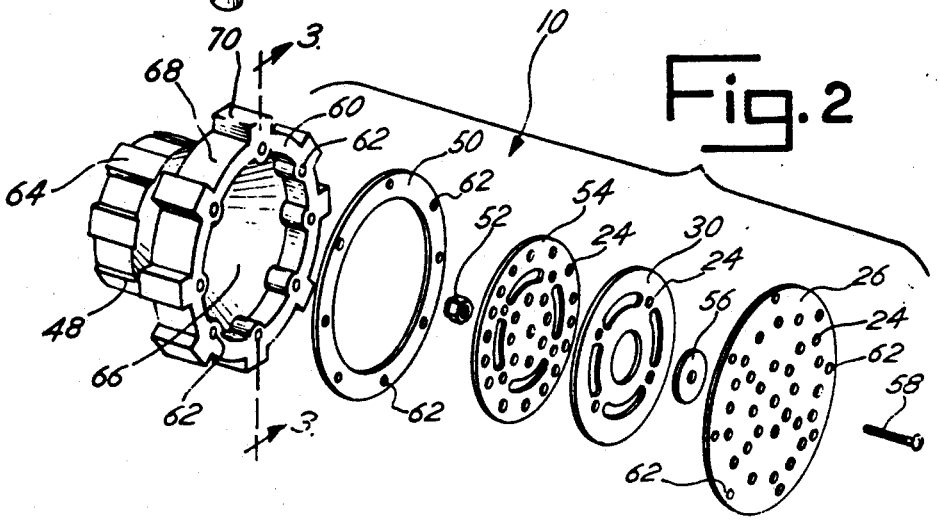
FIG. 2 is an exploded perspective view of the air flapper valve assembly of the present invention showing (respectively from left to right) the valve body, cover gasket, nut, back plate, flapper, spacer, cover plate, and torque screw.

Flapper valve assembly generally 10 as depicted in enlarged and exploded array in FIG. 2, and comprises (respectively from left to right) valve body 48, cover gasket 50, nut 52, back plate 54, flapper 30, spacer 56, cover plate 26, and torque screw 58. As is also shown in FIG. 2, torque screw 58 engages nut 52 to hold in close array as known in the art cover plate 26, spacer 56, flapper 30 and back plate 54. Each of cover plate 26, flapper 30, and back plate 54 has corresponding air holes 24 therein for inspiration of air therethrough in the pulse cycle, as is also known in the art.

Figure 3:
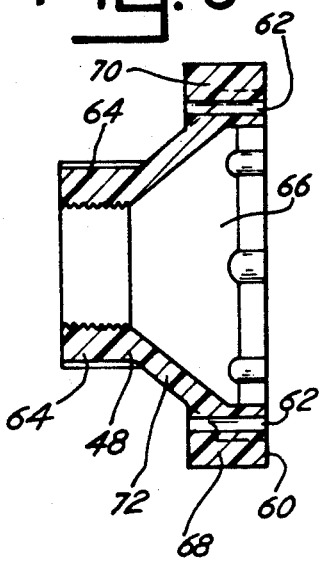
FIG. 3 is an enlarged longitudinal cross-sectional view through the valve body shown in FIG. 2 taken along lines 3—3, and showing the valve body with the cover gasket surface at the right side thereof, and showing at the left side thereof threaded securement means for attaching the valve body to the air input conduit for introduction of air into the combustion chamber.

As shown in FIGS. 2 and 3, valve body 48 comprises a cover gasket face 60 having cover screw holes 62 therein for holding cover plate 26 to cover gasket 50 (each of which has corresponding screw holes 62) and thereby to valve body 48, and for suspending flapper 30 between back plate 54 and cover plate 26 in the front opening of valve body 48. Valve body 48 further comprises an internally threaded air input conduit portion 64, which is generally cylindrical in shape, which is disposed at the opposite side from cover gasket surface 60, and which is of a diameter substantially less than the diameter of front opening 66 of valve body 48 for holding flapper 30 therewithin. Also generally cylindrical front flapper holder portion 68 of valve body 48, which may have lugged portions 70 thereon, and air input conduit portion 64 of valve body 48 are connected by a frusto-conical shaped intermediate portion 72. Each of the portions of valve body 48 is formed of an elastomeric material of substantial thickness, in order to absorb and diminish sound energy when in the installed condition.

Combustion chamber 18 is preferably made of ¾" cast iron, with an exterior surface having fins 74 thereon, and which is barrel shaped for improved heat transfer. Tail pipe 32 is preferably formed from a combination of stainless and aluminized steel in order to effectively withstand corrosion and high temperatures. The heavy gauge aluminized steel exhaust decouppler 38 has an air foil shape, as shown in FIG. 1, to provide low air resistance and efficient heat transfer to the condenser coils. Condenser coils 42 are formed preferably from stainless steel tubes, and which are equipped with aluminum fins 44 to provide a large face area. Also, the condenser coils 42 hereof have a minimum of air resistance. Preferably 2" PVC pipe (not shown) is used to bring in preferably outdoor air for combustion, thereby adding efficiency and eliminating possible corrosion problems if chlorine-containing indoor air were used. Chlorine is commonly found in many households due to the presence of chlorinated municipal water supplies, bleaches and solvents, all of which might cause corrosion, if indoor air were utilized. In addition, and due to the low venting temperature which is a direct result of a pulse furnace's high heating efficiency, PVC pipe of similar diameter (not shown) may also preferably be utilized for venting the exhaust, whether vertically or through a wall.

Thus, and as described above, the improved valve body 48 of the present invention isolates and absorbs the impact of flapper valve 10 from the conditioned space, while simultaneously maintaining the operative functioning of the air flapper valve assembly. The basic and novel characteristics of the improved methods and apparatus of the present invention will be readily understood from the foregoing disclosure by those skilled in the art. It will become readily apparent that various changes and modifications may be made in the form, construction and arrangement of the improved apparatus of the present invention, and in the steps of the inventive methods hereof, which various respective inventions are as set forth hereinabove without departing from the spirit and scope of such inventions. Accordingly, the preferred and alternative embodiments of the present invention set forth hereinabove are not intended to limit such spirit and scope in any way.

What is claimed is:

1. In an air flapper valve assembly for use in association with a pulse combustion furnace, the air flapper valve assembly connected to the air intake conduit thereof and having a valve body supporting a flapper valve disposed thereon, the improvement comprising:

a valve body formed from an elastomeric material having a hardness in the range of approximately 35 to 52 Shore D.

2. The improvement of claim 1 wherein said elastomeric material is selected from the group consisting of a heat stabilized copolyester EPDM, a copolyester EPDM, and copolypropylene EPDM.

3. The improvement of claim 2 wherein the heat stabilized copolyester EPDM is LOMOD XB0225.

4. The improvement of claim 2 wherein the copolyester EPDM is LOMOD B0220.

5. The improvement of claim 2 wherein the copolypropylene EPDM is Santoprene 103-40.

6. The improvement of claim 1 wherein said elastomeric material is substantially heat stable at temperatures of at least approximately 350° F.

* * * * *